US010236141B1

(12) United States Patent
Tsai et al.

(10) Patent No.: US 10,236,141 B1
(45) Date of Patent: Mar. 19, 2019

(54) KEY STRUCTURE

(71) Applicant: Primax Electronics Ltd., Taipei (TW)

(72) Inventors: Sheng-An Tsai, Taipei (TW); Li-Jen Chien, Taipei (TW); Hsiang-Wen Cheng, Taipei (TW); Jia-Jui Yang, Taipei (TW); Pai-Ping Hsu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/865,622

(22) Filed: Jan. 9, 2018

(30) Foreign Application Priority Data

Sep. 15, 2017 (TW) ..... 106131801 A

(51) Int. Cl.

| | |
|---|---|
| ***H01H 13/705*** | (2006.01) |
| ***H01H 13/83*** | (2006.01) |
| ***H01H 13/02*** | (2006.01) |
| ***H01H 3/12*** | (2006.01) |

(52) U.S. Cl.
CPC ..... *H01H 13/705* (2013.01); *H01H 3/125* (2013.01); *H01H 13/023* (2013.01); *H01H 13/83* (2013.01)

(58) Field of Classification Search
CPC ..... H01H 13/705; H01H 13/702; H01H 13/7065; H01H 13/7073; H01H 13/85; H01H 13/84
See application file for complete search history.

(56) References Cited

U.S. PATENT DOCUMENTS 8,354,606 B2 * 1/2013 Yokoyama ..... H01H 13/705 200/600
9,620,308 B1 * 4/2017 Li ..... H01H 13/85

* cited by examiner

*Primary Examiner* — Edwin A. Leon
*Assistant Examiner* — Lheiren Mae A Caroc
(74) *Attorney, Agent, or Firm* — Muncy, Geissler, Olds & Lowe, P.C.

(57) ABSTRACT

A key structure includes a membrane switch circuit member, a rubbery elastomer, a housing, a triggering element, a metallic elastic element and a keycap. The keycap is disposed on the triggering element. The rubbery elastomer is disposed on the membrane switch circuit member. The housing is located over the rubbery elastomer. The triggering element is movable relative to the housing. The metallic elastic element is contacted with the triggering element. While the keycap is depressed, the triggering element is moved relative to the housing to press the metallic elastic element. While the metallic elastic element is pushed by the triggering element, the metallic elastic element is swung to collide with the triggering element. Consequently, a click sound is generated.

9 Claims, 6 Drawing Sheets

KEY STRUCTURE

FIELD OF THE INVENTION

The present invention relates to a key structure, and more particularly to a mechanical key structure.

BACKGROUND OF THE INVENTION

Generally, the widely-used peripheral input device of a computer system includes for example a mouse, a keyboard, a guiding trackball, or the like. For example, characters or symbols can be directly inputted into the computer system via the keyboard. As a consequence, most users and most manufacturers of input devices pay much attention to the development of keyboards.

Hereinafter, a key structure of a conventional keyboard will be illustrated with reference to FIG. 1. FIG. 1 is a schematic side cross-sectional view illustrating a conventional key structure. As shown in FIG. 1, the conventional key structure 1 comprises a keycap 11, a scissors-type connecting element 12, a rubbery elastomer 13, a membrane switch circuit member 14 and a base plate 15. The keycap 11, the scissors-type connecting element 12, the rubbery elastomer 13 and the membrane switch circuit member 14 are supported by the base plate 15. The scissors-type connecting element 12 is used for connecting the base plate 15 and the keycap 11. Consequently, the keycap 11 is movably fixed on the base plate 15.

The membrane switch circuit member 14 comprises plural key intersections (not shown). When one of the plural key intersections is triggered, a corresponding key signal is generated. The rubbery elastomer 13 is disposed on the membrane switch circuit member 14 and enclosed by the scissors-type connecting element 12. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The scissors-type connecting element 12 is arranged between the base plate 15 and the keycap 11, and the base plate 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base plate 15. Moreover, the first frame 121 comprises a first keycap post 1211 and a first base plate post 1212. The first frame 121 is connected with the keycap 11 through the first keycap post 1211. The first frame 121 is connected with the base plate 15 through the first base plate post 1212. The second frame 122 is combined with the first frame 121. A first end of the second frame 122 is connected with the base plate 15. A second end of the second frame 122 is connected with the keycap 11. Moreover, the second frame 122 comprises a second keycap post 1221 and a second base plate post 1222. The second frame 122 is connected with the keycap 11 through the second keycap post 1221. The second frame 122 is connected with the base plate 15 through the second base plate post 1222.

The operations of the conventional key structure 1 in response to the depressing action of the user will be illustrated as follows. Please refer to FIG. 1 again. When the keycap 11 is depressed, the keycap 11 is moved downwardly to push the scissors-type connecting element 12 in response to the depressing force. As the keycap 11 is moved downwardly relative to the base plate 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed. However, when the key structure 1 is depressed, the user cannot feel the depressing feedback.

With increasing development of science and technology, a mechanical key structure is introduced into the market. FIG. 2 is a schematic side cross-sectional view illustrating a conventional mechanical key structure. As shown in FIG. 2, the mechanical key structure 2 comprises a keycap (not shown), a pedestal 21, an upper cover 22, a push element 23, a linkage element 24, a first spring strip 25, a second spring strip 26 and a circuit board (not shown). The pedestal 21 is covered by the upper cover 22. The upper cover 22 has an opening 221. The linkage element 24 is located at a middle region of the pedestal 21. Moreover, the linkage element 24 is movable upwardly or downwardly relative to the pedestal 21. The first spring strip 25 is partially disposed within the pedestal 21, and located near a sidewall of the pedestal 21. The second spring strip 26 is partially disposed within the pedestal 21, and arranged between the linkage element 24 and the first spring strip 25. The push element 23 and the linkage element 24 are collaboratively disposed on the pedestal 21. The push element 23 is penetrated through the opening 221 and coupled with the keycap. Moreover, the first spring strip 25 and the second spring strip 26 are electrically connected with the circuit board.

Please refer to FIG. 2 again. The linkage element 24 has a protrusion structure 241. The protrusion structure 241 is extended from a sidewall of the linkage element 24 toward the first spring strip 25. Moreover, the first spring strip 25 comprises a fixing part 251 and an elastic part 252. The fixing part 251 is fixed on the pedestal 21. The elastic part 252 is extended from the fixing part 251. Moreover, the elastic part 252 is contacted with the protrusion structure 241 of the linkage element 24. Consequently, the elastic part 252 is movable relative to the fixing part 251.

When the keycap is depressed, the keycap is moved downwardly to push the push element 23. Consequently, the linkage element 24 connected with the push element 23 is moved downwardly. As the linkage element 24 is moved downwardly, the protrusion structure 241 of the linkage element 24 is contacted with the elastic part 252 and moved downwardly along the elastic part 252. While the linkage element 24 is quickly moved in response to the depressing force of the user, the linkage element 24 is quickly moved across the elastic part 252, and the elastic part 252 is pushed by the protrusion structure 241 of the linkage element 24. Consequently, the elastic part 252 is moved relative to the fixing part 251 to collide with the second spring strip 26. Since the first spring strip 25 and the second spring strip 26 are contacted with each other, the circuit board outputs a corresponding key signal. Moreover, while the first spring strip 25 and the second spring strip 26 are contacted with each other, a click sound is generated. Due to the click sound, the user can feel the depressing feedback.

Since the mechanical key structure 2 generates the click sound to provide the feedback feel while the keycap is depressed, the mechanical key structure 2 is favored by many users. However, the conventional mechanical key structure 2 still has some drawbacks. For example, since the conventional mechanical key structure 2 requires many components, the conventional mechanical key structure 2 is complicated and not cost-effective.

Therefore, there is a need of providing a key structure with low cost and capable of generating depressing feedback.

SUMMARY OF THE INVENTION

The present invention provides a key structure that is similar to a mechanical key structure. The key structure is cost-effective and capable of generating depressing feedback.

In accordance with an aspect of the present invention, there is provided a key structure. The key structure includes a membrane switch circuit member, a rubbery elastomer, a housing, a triggering element, a metallic elastic element and a keycap. When the membrane switch circuit member is triggered, a key signal is generated. The rubbery elastomer is disposed on the membrane switch circuit member. When the rubbery elastomer is depressed, the membrane switch circuit member is triggered by the rubbery elastomer. The housing is located over the rubbery elastomer, and includes an opening and a receiving part. The opening runs through the housing. The receiving part is located beside an inner wall of the housing. The triggering element is inserted into the opening and movable relative to the housing. When the triggering element is pushed, the triggering element presses the rubbery elastomer. The metallic elastic element is accommodated within the receiving part and contacted with the triggering element. While the metallic elastic element is pushed by the triggering element, the metallic elastic element is swung to collide with the triggering element or the housing, so that a click sound is generated. The keycap is coupled with the triggering element. When the keycap is depressed, the triggering element is pushed by the keycap.

From the above descriptions, the key structure of the present invention comprises the membrane switch circuit member, the rubbery elastomer, the triggering element, the housing and the metallic elastic element. The metallic elastic element has a special shape. The mechanism of these components is similar to a mechanical key structure. Due to the linkage between the triggering element and the metallic elastic element, a click sound is generated and a tactile feel is enhanced. In comparison with the conventional mechanical key structure, the key structure of the present invention is simpler. Moreover, the connection relationship and the operations between the components of the key structure of the present invention are more stable, and thus the possibility of causing erroneous operation is minimized. In other words, the key structure of the present invention is similar to a mechanical key structure. The key structure is cost-effective and capable of generating depressing feedback. Consequently, the problems of the conventional technology are overcome.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a key structure.

Figure 1:
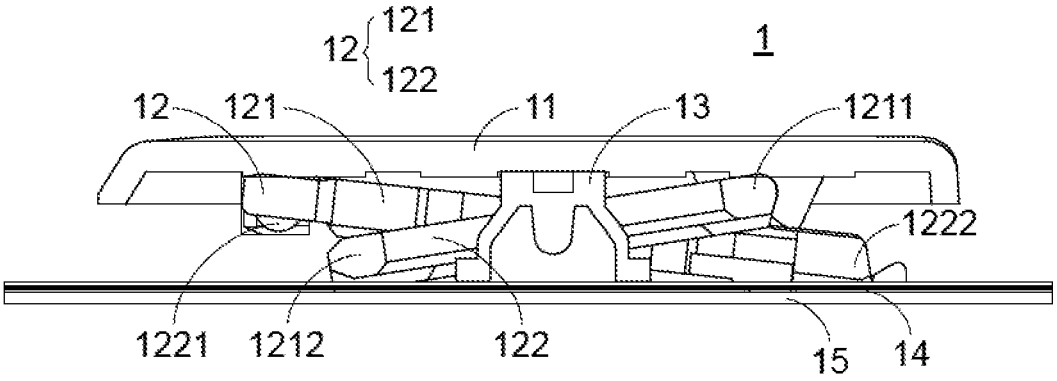
FIG.1 PRIOR ART
FIG. 1 is a schematic side cross-sectional view illustrating a conventional key structure.
Figure 2:
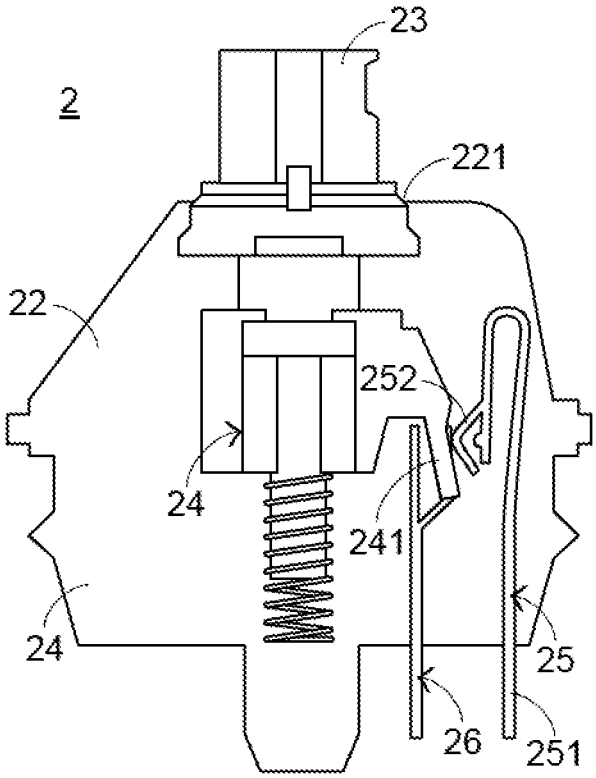
FIG.2 PRIOR ART
FIG. 2 is a schematic side cross-sectional view illustrating a conventional mechanical key structure.
Figure 3:
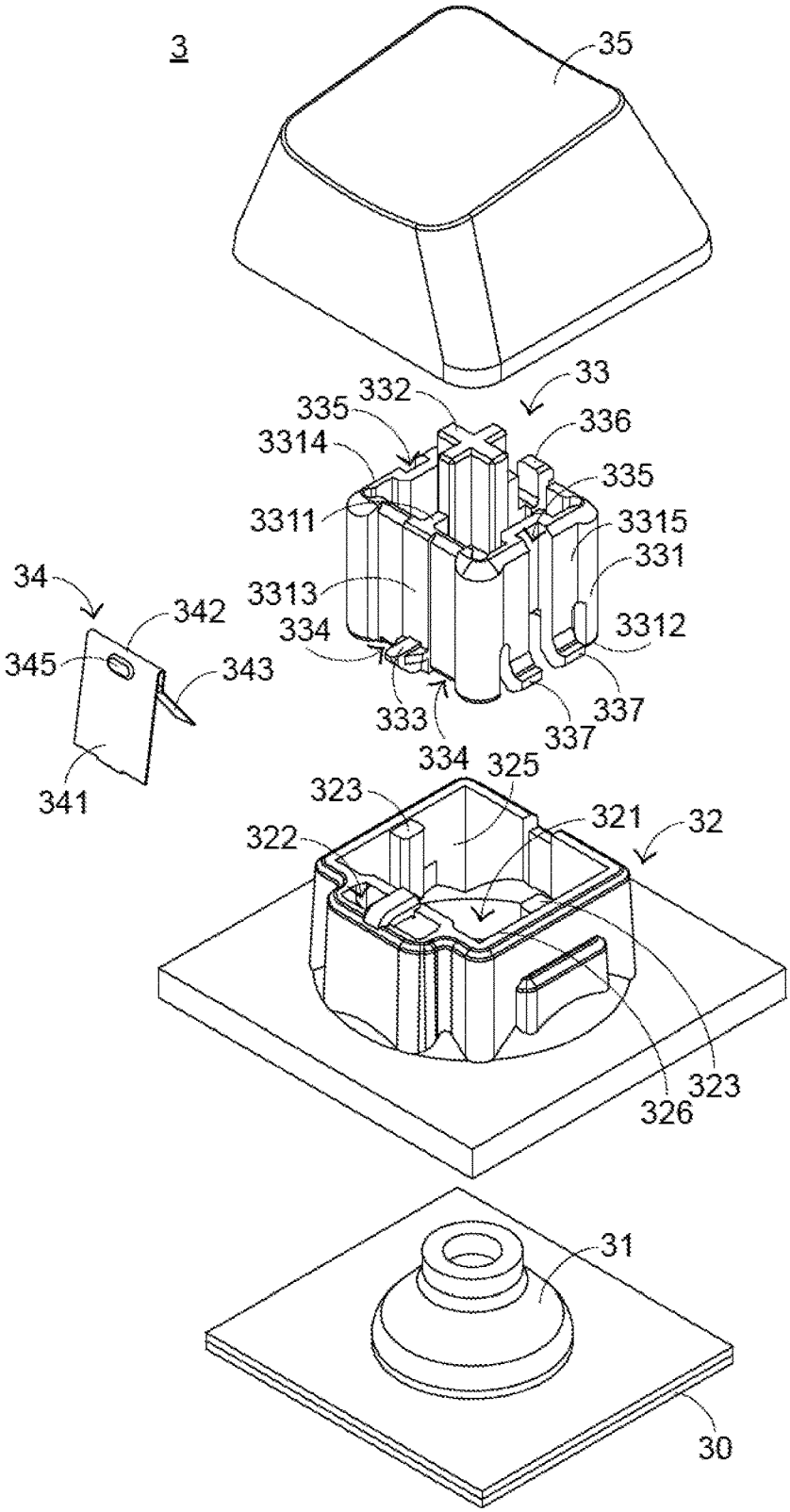
FIG. 3 is a schematic exploded view illustrating a key structure according to an embodiment of the present invention.
Figure 4:
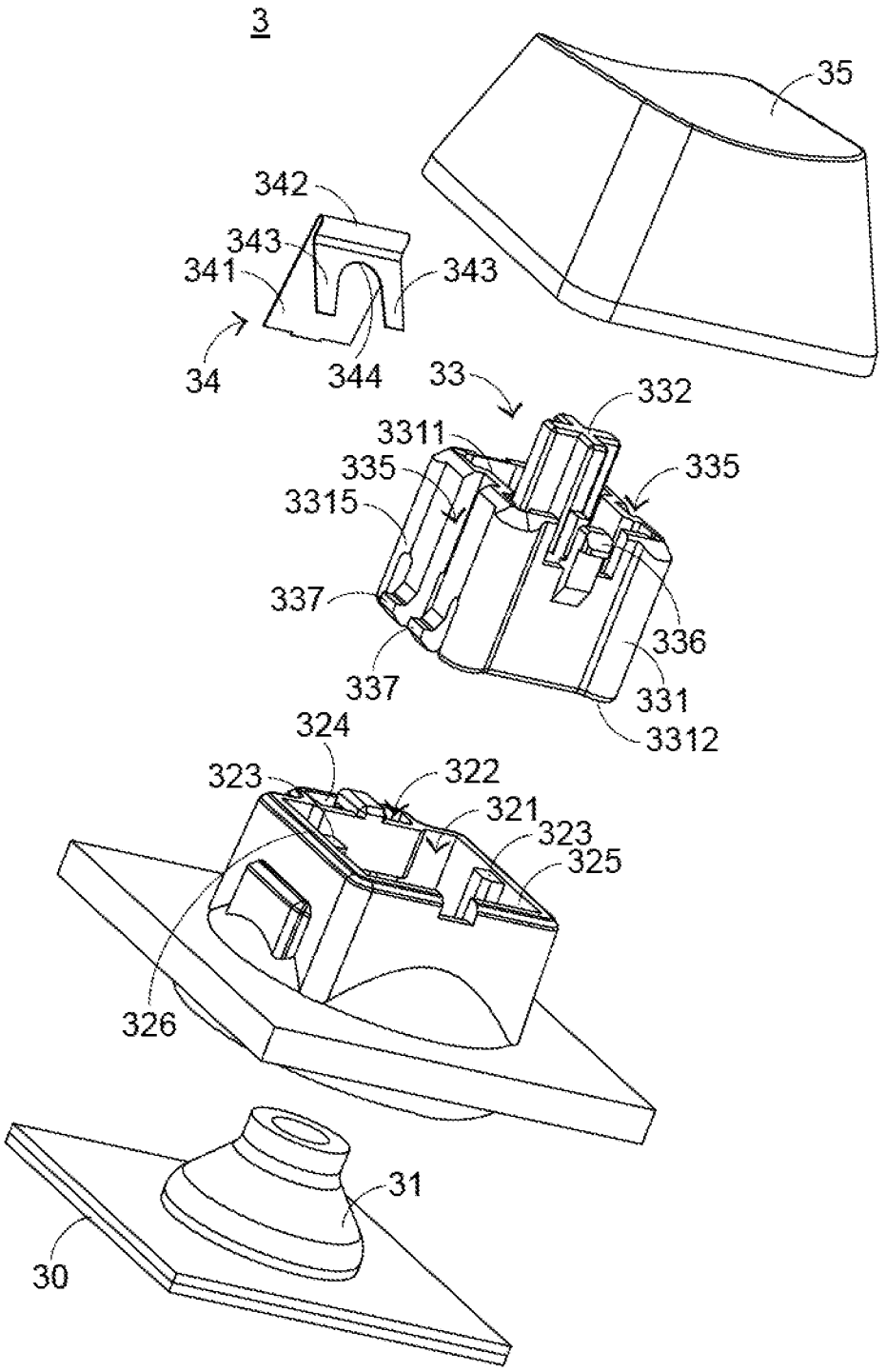
FIG. 4 is a schematic exploded view illustrating the key structure of FIG. 3, and taken along another viewpoint.
Figure 5:
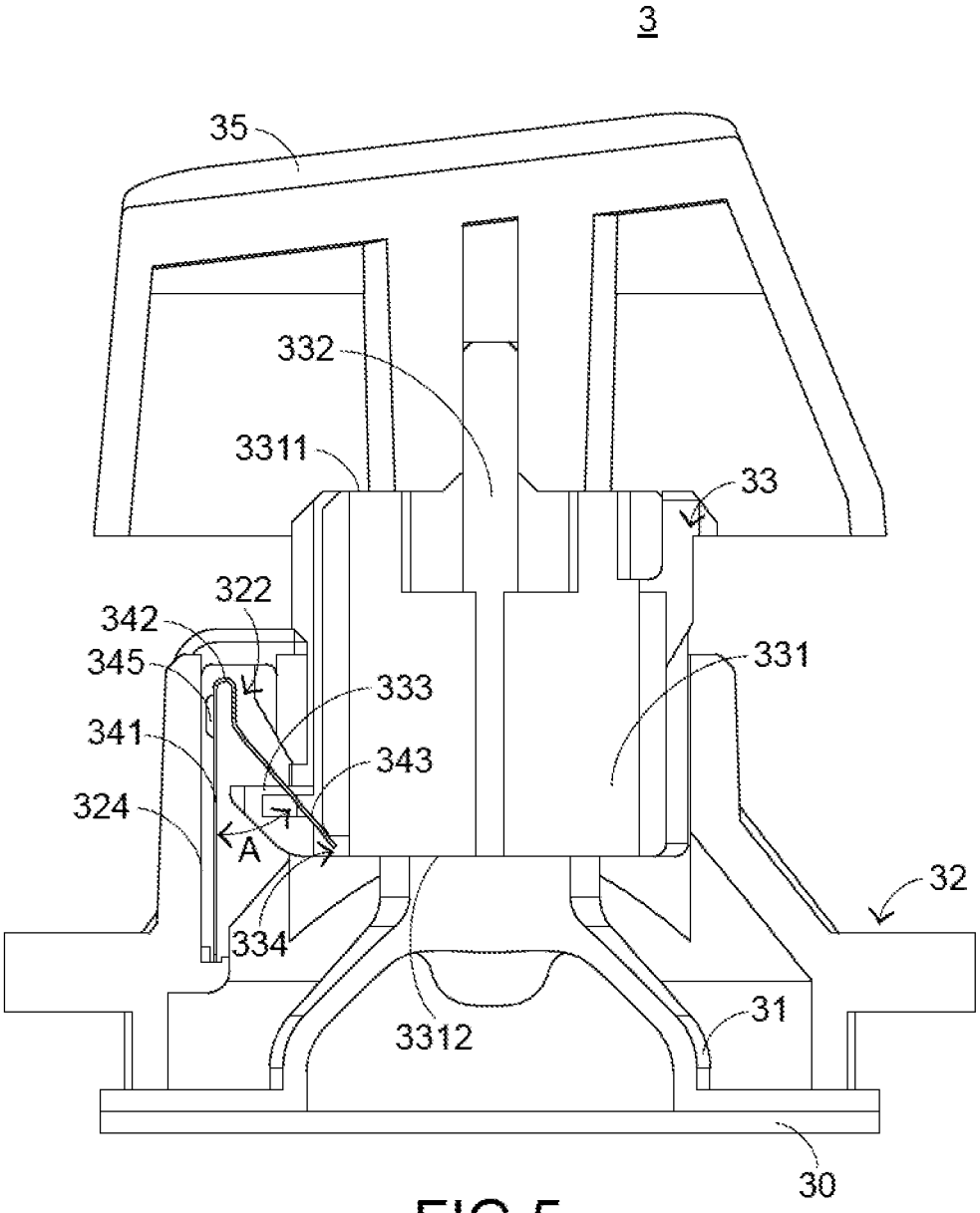
FIG. 5 is a schematic cross-sectional view illustrating the key structure according to the embodiment of the present invention.

Please refer to FIGS. 3, 4 and 5. FIG. 3 is a schematic exploded view illustrating a key structure according to an embodiment of the present invention. FIG. 4 is a schematic exploded view illustrating the key structure of FIG. 3, and taken along another viewpoint. FIG. 5 is a schematic cross-sectional view illustrating the key structure according to the embodiment of the present invention. In this embodiment, the key structure 3 comprises a membrane switch circuit member 30, a rubbery elastomer 31, a housing 32, a triggering element 33, a metallic elastic element 34 and a keycap 35. When the membrane switch circuit member 30 is triggered, a key signal is generated. The rubbery elastomer 31 is disposed on the membrane switch circuit member 30. When the rubbery elastomer 31 is depressed, the rubbery elastomer 31 is subjected to deformation to trigger the membrane switch circuit member 30. The housing 32 is located over the rubbery elastomer 31. Moreover, the housing 32 comprises an opening 321, a receiving part 322 and plural guiding posts 323. The opening 321 runs through the housing 32 in the vertical direction. The receiving part 322 located beside a first inner wall 324 of the housing 32. The plural guiding posts 323 are disposed on a second inner wall 325 and a third inner wall 326 of the housing 32. The structure of the membrane switch circuit member 30 is well known to those skilled in the art, and is not redundantly described herein.

The triggering element 33 is inserted into the opening 321 and movable relative to the housing 32 in the vertical direction. As the triggering element 33 is pushed, the triggering element 33 presses the rubbery elastomer 31. The metallic elastic element 34 is accommodated within the receiving part 322 and contacted with the triggering element 33. While the triggering element 33 is moved, the metallic elastic element 34 is pushed by the triggering element 33 and the metallic elastic element 34 is swung accordingly. As the metallic elastic element 34 is swung to collide with the triggering element 33 or the housing 32, a click sound is generated. The keycap 35 is coupled with the triggering element 33. While the keycap 35 is depressed by the user, the keycap 35 is moved downwardly in the vertical direction so as to push the triggering element 33.

Figure 6:
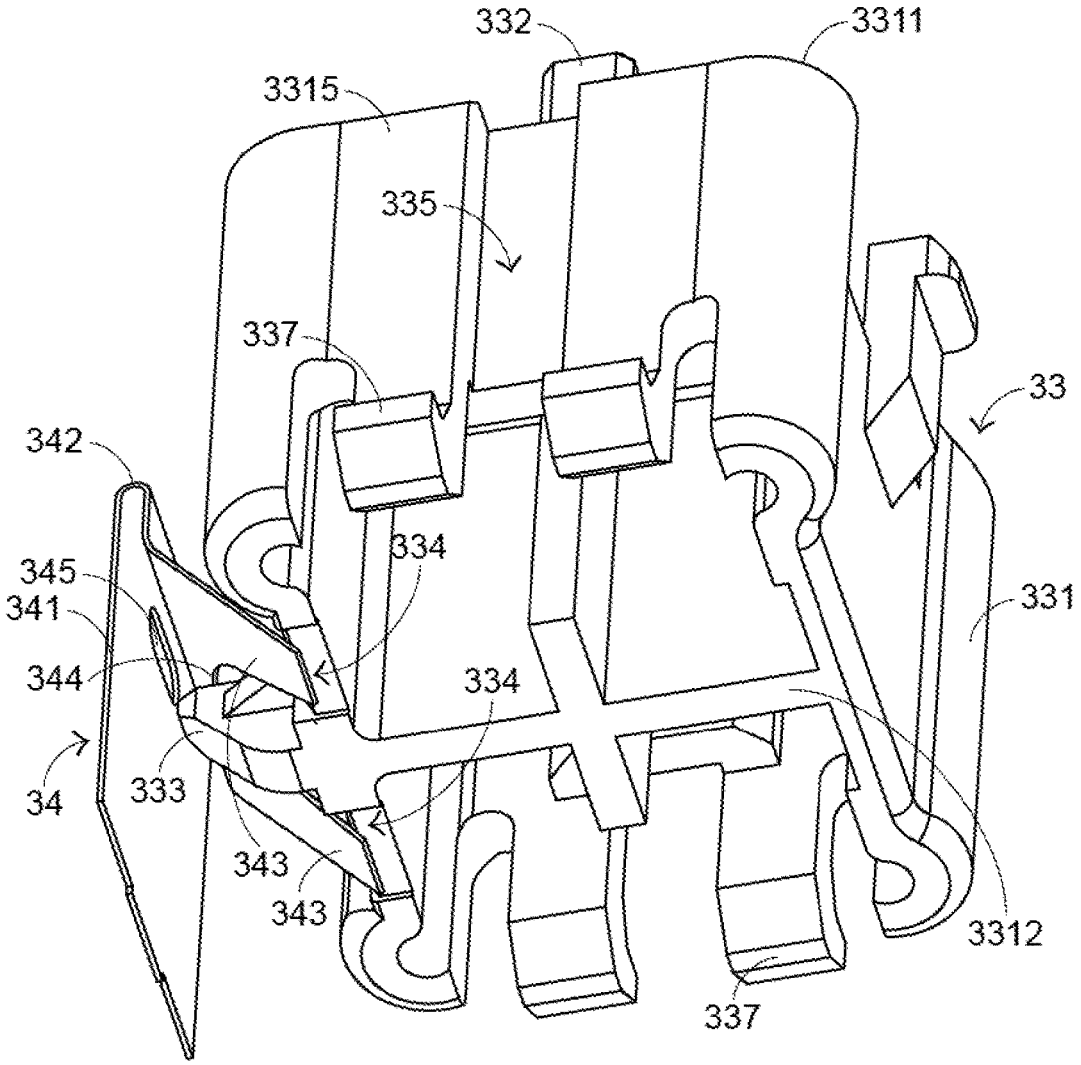
FIG. 6 is a schematic perspective view illustrating the relationship between the triggering element and the metallic elastic element of the key structure according to the embodiment the present invention.

Please refer to FIGS. 3, 4, 5 and 6. FIG. 6 is a schematic perspective view illustrating the relationship between the triggering element and the metallic elastic element of the key structure according to the embodiment the present invention. The triggering element 33 comprises a main body 331, a connecting part 332, a positioning part 333, plural recesses 334, plural guiding tracks 335, a first stopping part 336 and plural second stopping parts 337. The connecting part 332 is protruded from a first end 3311 of the main body 331. The connecting part 332 is connected with the keycap 35. The positioning part 333 is disposed on a first sidewall 3313 of the main body 331 and arranged near the connecting part 332. The positioning part 333 is penetrated through the metallic elastic element 34. Consequently, the metallic elastic element 34 is fixed in the receiving part 322. The plural recesses 334 are located at a second end 3312 of the main body 331 and arranged near the positioning part 333. A portion of the metallic elastic element 34 is accommodated within the recesses 334. The plural guiding tracks 335 are formed in a second sidewall 3314 and a third sidewall 3315 of the main body 331. The plural guiding tracks 335 are aligned with the plural guiding posts 323, respectively. The guiding posts 323 are inserted into the corresponding guiding tracks 335. Consequently, the triggering element 33 can be moved relative to the housing 32 along the plural guiding posts 323 in the vertical direction.

The first stopping part 336 is located at the first end 3311 of the main body 331. The first stopping part 336 is contacted with the housing 32 to stop the triggering element 33. Consequently, the triggering element 33 is not detached from the opening 321. The function of the plural second stopping parts 337 is similar to the function of the first stopping part 336. The plural second stopping parts 337 are located at the second end 3312 of the main body 331. The plural second stopping parts 337 are contacted with the housing 32 to stop the triggering element 33. Consequently, the triggering element 33 is not detached from the opening 321. In an embodiment, the connecting part 332, the positioning part 333, the first stopping part 336 and the plural second stopping parts 337 are integrally formed with the main body 331. Moreover, these components are made of plastic material.

The metallic elastic element 34 comprises a main plate 341, a bent part 342, plural protrusion arms 343, a hollow part 344 and a bulge 345. The main plate 341 is disposed within the receiving part 322. The bent part 342 is connected with the main plate 341. Moreover, the bent part 342 has a U-shaped structure. As shown in FIGS. 5 and 6, the plural protrusion arms 343 are connected with the bent part 342 and partially accommodated within the corresponding recesses 334 of the triggering element 33. The hollow part 344 is arranged between the plural protrusion arms 343. The positioning part 333 is penetrated through the hollow part 344. Consequently, the main plate 341 is fixed in the receiving part 322. The bulge 345 is disposed on the main plate 341 and arranged near the first inner wall 324 of the housing 32. While the main plate 341 is swung, the bulge 345 collides with the first inner wall 324 of the housing 32 to generate the click sound. In this embodiment, the bent part 342, the plural protrusion arms 343 and the bulge 345 are integrally formed with the main plate 341. Moreover, the metallic elastic element 34 has an inverted-Y shape.

Figure 7:
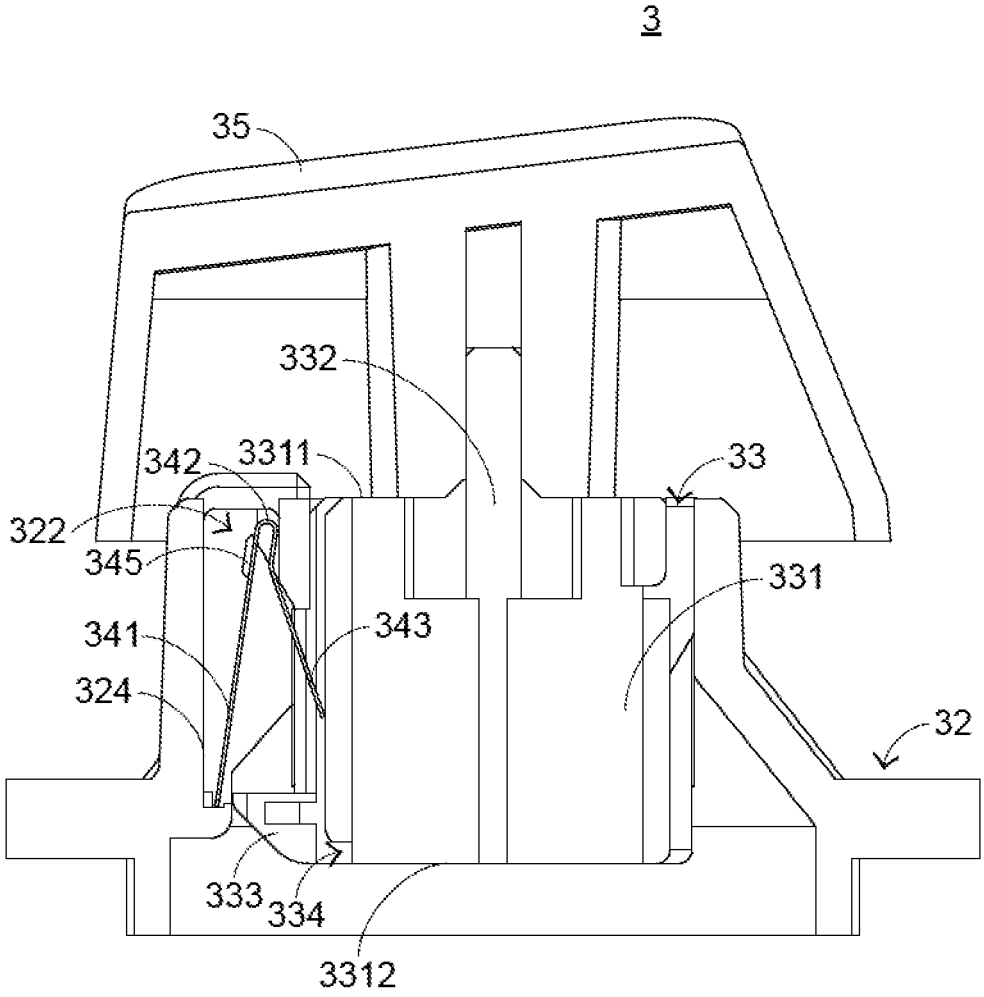
FIG. 7 is a schematic cross-sectional view illustrating the key structure according to the embodiment of the present invention, in which the key structure is in a depressed state.

The operations of the key structure 3 in response to the depressing action of the user will be illustrated as follows. Please refer to FIGS. 3, 4, 5, 6 and 7. FIG. 7 is a schematic cross-sectional view illustrating the key structure according to the embodiment of the present invention, in which the key structure is in a depressed state.

While the keycap 35 is depressed by the user, the keycap 35 is moved downwardly to push the first end 3311 of the main body 331 of the triggering element 33 and the triggering element 33 is moved downwardly relative to the housing 32. While the triggering element 33 is moved downwardly, the plural protrusion arms 343 of the metallic elastic element are continuously pushed by the corresponding recesses 334. Consequently, the plural protrusion arms 343 are detached from the recesses 334. In response to the metallic elasticity of the metallic elastic element 34, the plural protrusion arms 343 are swung at high speed to collide with the main body 331. Meanwhile, a first click sound is generated. The key structure 3 in the depressed state can be seen in FIG. 7. Moreover, while the main body 331 is moved downwardly to press the rubbery elastomer 31, the rubbery elastomer 31 is subjected to compressible deformation to trigger the membrane switch circuit member 30. Consequently, the membrane switch circuit member 30 generates a corresponding key signal. Moreover, while the triggering element 33 is moved downwardly, the triggering element 33 is moved relative to the housing 32 in the vertical direction through the plural guiding posts 323 and the plural guiding tracks 335.

When the keycap 35 is no longer pressed by the user, no external force is applied to the keycap 35. In response to the elasticity of the rubbery elastomer 31, the rubbery elastomer 31 is restored from the deformed state to its original shape to provide an upward elastic force to the main body 331 of the triggering element 33. In response to the upward elastic force, the main body 331 of the triggering element 33 pushes the keycap 35 to its original position. Moreover, while the triggering element 33 is moved upwardly, the metallic elastic element 34 in the status of FIG. 7 is swung toward the first inner wall 324 of the housing 32. Consequently, the bulge 345 on the main plate 341 collides with the first inner wall 324 of the housing 32 to generate a second click sound. When the metallic elastic element 34 is no longer swung, the metallic elastic element 34 is restored to the status of FIG. 5.

The following three aspects should be specially described. Firstly, there is an included angle A between the protrusion arms 343 and the main plate 341 of the metallic elastic element 34. According to the angle A, the tactile feel of the key structure 3 is adjustable through the metallic elastic element 34. For example, in case that the angle A is larger, the forces of the protrusion arms 343 exerted on the corresponding recesses 334 of the triggering element 33 are larger to provide heavier tactile feel to the user. Whereas, in case that the angle A is smaller, the forces of the protrusion arms 343 exerted on the corresponding recesses 334 of the triggering element 33 are smaller to provide lighter tactile feel to the user.

Secondly, the shapes of the protrusion arms 343 may be varied according to the practical requirements. Consequently, the interference between the protrusion arms 343 and the triggering element 33 will be increased or decreased. In such way, the tactile feel of the key structure 3 is adjusted, and the timing of swinging the metallic elastic element 34 controlled. In other words, the timing of generating the click sound can be controlled.

Thirdly, the key structure of the present invention further provides an illuminating function according to the practical requirements. For example, a circuit board and a top-view light emitting diode are located under the membrane switch circuit member, and the rubbery elastomer, the housing and the triggering element are made of a light-transmissible material. After the light beam emitted by the top-view light emitting diode is transmitted through the membrane switch circuit member, the rubbery elastomer, the housing and the triggering element, the light beam is projected to the keycap to illuminate the keycap. The above example is presented herein for purpose of illustration and description only. In another embodiment, the key structure is further equipped with a side-view light emitting diode, a circuit board and a light guide plate to provide the illuminating function.

From the above descriptions, the key structure of the present invention comprises the membrane switch circuit member, the rubbery elastomer, the triggering element, the housing and the metallic elastic element. The metallic elastic element has a special shape. The mechanism of these components is similar to a mechanical key structure. Due to the linkage between the triggering element and the metallic elastic element, a click sound is generated and a tactile feel is enhanced. In comparison with the conventional mechanical key structure, the key structure of the present invention is simpler. Moreover, the connection relationship and the operations between the components of the key structure of the present invention are more stable, and thus the possibility of causing erroneous operation is minimized. In other words, the key structure of the present invention is similar to a mechanical key structure. The key structure is cost-effective and capable of generating depressing feedback. Consequently, the problems of the conventional technology are overcome.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a membrane switch circuit member, wherein when the membrane switch circuit member is triggered, a key signal is generated;

a rubbery elastomer disposed on the membrane switch circuit member, wherein when the rubbery elastomer is depressed, the membrane switch circuit member is triggered by the rubbery elastomer;

a housing located over the rubbery elastomer, and comprising an opening and a receiving part, wherein the opening runs through the housing, and the receiving part is located beside an inner wall of the housing; a triggering element inserted into the opening and movable relative to the housing, wherein when the triggering element is pushed, the triggering element presses the rubbery elastomer the triggering element comprising:

a main body;

a connecting part protruded from a first end of the main body, and connected with a keycap; and a positioning part disposed on a sidewall of the main body, wherein the positioning part is penetrated through a metallic elastic element, so that the metallic elastic element is fixed in the receiving part; and plural recesses located at a second end of the main body, wherein a portion of the metallic elastic element is accommodated within the plural recesses;

the metallic elastic element accommodated within the receiving part and contacted with the triggering element, wherein while the metallic elastic element is pushed by the triggering element, the metallic elastic element is swung to collide with the triggering element or the housing, so that a click sound is generated; and the keycap coupled with the triggering element, wherein when the keycap is depressed, the triggering element is pushed by the keycap.

2. The key structure according to claim 1, wherein the metallic elastic element comprises:

a main plate disposed within the receiving part;

a bent part connected with the main plate;

plural protrusion arms connected with the bent part and partially accommodated within the corresponding recesses of the triggering element; and a hollow part arranged between the plural protrusion arms, wherein the positioning part of the triggering element is penetrated through the hollow part, so that the main plate is fixed in the receiving part.

3. The key structure according to claim 2, wherein the bent part and the plural protrusion arms are integrally formed with the main plate.

4. The key structure according to claim 2, wherein while the keycap is depressed, the triggering element is pushed by the keycap and the triggering element is moved relative to the housing, wherein while the triggering element is moved relative to the housing, the plural protrusion arms are pushed by the corresponding recesses and detached from the corresponding recesses, and the plural protrusion arms are swung to collide with the main body of the triggering element in response to metallic elasticity of the metallic elastic element, so that a click sound is generated.

5. The key structure according to claim 4, wherein the metallic elastic element further comprises a bulge, and the bulge is disposed on the main plate, wherein while the main body is swung, the bulge collides with the inner wall of the housing to generate another click sound.

6. The key structure according to claim 2, wherein there is an included angle between the protrusion arms and the main plate of the metallic elastic element, and a tactile feel of the key structure is adjustable through the metallic elastic element according to the angle.

7. The key structure according to claim 1, wherein the triggering element further comprises:

a guiding track formed in another sidewall of the main body;

a first stopping part located at the first end of the main body, and contacted with the housing, wherein the triggering element is stopped by the first stopping part, so that the triggering element is not detached from the opening; and a second stopping part located at the second end of the main body, and contacted with the housing, wherein the triggering element is stopped by the second stopping part, so that the triggering element is not detached from the opening.

8. The key structure according to claim 7, wherein the housing further comprises a guiding post corresponding to the guiding track, wherein the guiding track is disposed on another inner wall of the housing and inserted into the guiding track, so that the triggering element is movable relative to the housing along the guiding post.

9. The key structure according to claim 7, wherein the connecting part, the positioning part, the first stopping part and the second stopping part are integrally formed with the main body.

* * * * *